United States Patent [19]

Neves

[11] 4,333,739

[45] Jun. 8, 1982

[54] BLENDED ETHANOL FUEL

[76] Inventor: Alan M. Neves, 1596 24th St., Ogden, Utah 84401

[21] Appl. No.: 87,618

[22] Filed: Oct. 23, 1979

[51] Int. Cl.[3] ..... C10L 1/02

[52] U.S. Cl. ..... 44/52; 44/53; 44/56; 44/58

[58] Field of Search ..... 44/52, 53, 56, 58

[56] References Cited

U.S. PATENT DOCUMENTS

| | | | |
|---|---|---|---|
| 1,504,837 | 8/1924 | Ricardo | 44/53 |
| 1,907,309 | 5/1933 | Van Schoach, Jr. | 44/56 |
| 2,365,009 | 12/1944 | Robertson | 44/53 |
| 2,404,094 | 7/1946 | Robertson | 44/52 |

OTHER PUBLICATIONS

Crombie, L., Making Alcohol Fuel: Recipe and Procedure, 93–95 (1979).

Stohrer, A. W., "Summary Letter Report on the Preparation of the Petrol, Alcohol and Water Phases in Gasohol" (Mar. 15, 1979).

*Primary Examiner*—Jacqueline V. Howard

*Attorney, Agent, or Firm*—H. Ross Workman; Allen R. Jensen; Rick D. Nydegger

[57] ABSTRACT

A blended ethanol-based fuel for use as a substitute to conventional petroleum fuels in existing engines, without modification, comprising water, a gaseous hydrocarbon (such as acetylene or propane), a binding component (such as benzene), and a lubricating oil.

11 Claims, No Drawings

BLENDED ETHANOL FUEL

BACKGROUND

1. Field of the Invention

The present invention relates to a new liquid fuel; more particularly, it relates to new ethanol-based liquid fuels which can be used as substitutes for petroleum fuels in conventional engines, such as internal combustion, "diesel," and jet engines, without modification to the engines.

2. The Prior Art

With the steadily increasing demand for liquid fuels and the decreasing supply of petroleum crude oil, researchers have been forced to look to alternative fuels in order to fulfill the future demands for liquid fuels. Recent events throughout the world, including the shortage of petroleum crude oil, the sharp increase in the cost of oil and gasoline motor fuels, and the political instability of some crude oil producing countries, have demonstrated the vulnerability of the present sources for liquid fuel. Nevertheless, even if these supply and economic risks were acceptable, it is clear that worldwide product of petroleum products at projected levels can neither keep pace with the increasing demand nor continue indefinitely. It is becoming increasingly evident that the time will soon come when there will have to be a transition to resources which are more plentiful and preferably renewable.

Ethanol has been recognized as a possible liquid fuel alternative which can be available in significant quantities throughout the remainder of this century. See "The Report of the Alcohol Fuels Policy Review" (Dept. of Energy/Pe-0012, June 1979). However, only in light of the recent rapidly rising costs of petroleum products has the cost of an ethanol-based alternative fuel become economically competitive. It will be appreciated that the blended ethanol-based fuel of the present application, when considered with the continuous method of ethanol production disclosed in copending application Ser. No. 088,196 filed on Oct. 23, 1979, will be not only economically competitive in the existing price market of petroleum fuels, but may even be produced at a cost below that of existing petroleum fuels.

It has long been recognized that ethanol may under the proper conditions be useful as a liquid fuel capable of performing equal to, if not better than, conventional petroleum fuels. However, most of the research in this area is old, having been conducted over fifty years ago, before the discovery of the vast Arabian oil fields. There is a considerable amount of literature relative to various mixtures of ethanol and gasoline. In fact, such mixtures (commonly referred to as "gasohol") are sold for use in typical automobile engines in many outlets in the United States and other countries of the world. Also, ethanol in much higher concentrations has been the basic compenent of the fuels used in certain modified high performance engines, such as in race cars. Nevertheless, there has been little, if any, successful research conducted on the use of ethanol-based fuels in unmodified engines, such as conventional automobile engines.

Researchers have looked to ethanol as a component in conventional petroleum fuels because it has a higher thermal efficiency than ordinary petroleum motor fuels. When burned in typical automobile engines, ordinary petroleum fuels convert only about a quarter of the energy of the fuel into useful work, i.e., ordinary motor fuels only have about a 25% thermal efficiency. However, experiments have shown that when about 10% to 25% ethanol is blended with conventional petroleum fuels, the resulting fuel has a slightly greater thermal efficiency than straight petroleum fuel. Other studies have shown that high concentrations (about 95%) of ethanol can be burned in modified engines with much greater thermal efficiency than conventional petroleum fuels. Nevertheless, still other studies using engines designed to run on conventional petroleum fuels have shown that in terms of power, 100% ethanol fell short delivering the power of ordinary petroleum fuels.

Accordingly, those skilled in the art have generally limited their use of ethanol to that of an additive in petroleum fuels. Until the present invention, it had been thought necessary to significantly modify conventional engines (such as to make modifications in the carburetor or the compression ratio) in order to use a fuel which is predominantly ethanol. In addition, there are several other problems which have led those skilled in the art away from using ethanol as the primary component in a substitute liquid fuel in conventional engines. Such problems, which have heretofore not been solved by those skilled in the art, have been taken into account in the blended ethanol-based liquid fuel of the present invention resulting in blended ethanol fuel which can be used as a substitute for ordinary petroleum fuels in unmodified engines.

For example, ethanol has a lower heating value than gasoline—only about 81,900 BTU per gallon as compared to about 136,500 BTU per gallon of gasoline. While the heat value of a volatile liquid fuel bears little relationship to the power output obtainable from that fuel, it can effect other aspects of engine performance. When running on ethanol, engine temperatures are lower than when running on conventional motor fuels. This is essentially because the higher latent heats of the ethanol give a lower induction-stroke temperature and, consequently, a lower average temperature over the whole cycle. The lower flame temperatures of ethanol also lower the average temperature over the whole cycle. In the case of 95% ethanol, it has been shown that the temperature at the end of compression is about 158° F. lower than the temperature of ordinary petroleum fuels. Furthermore, the maximum flame temperature attained by 95% ethanol has been shown to be approximately 225° F. lower than ordinary petroleum fuels. Hence, the transfer of heat to the cooling water is substantially reduced. This reduction in the cooling water temperature may be advantageous under certain operating conditions, such as in hot summer weather or in hilly or dusty terrain. However, this lower cooling water temperature can create substantial problems in starting the engine and can require a much longer period for the engine to become thoroughly warmed up, especially in winter weather.

Additionally, the stoichiometric air to fuel ratio impacts the difficulty with which a cold engine is started. The air to fuel ratio of ordinary fuel is about 14.6 (that is, for perfect combustion, it takes 14.6 volumes of air to one volume of vaporized fuel), whereas the proper stoichiometric air to fuel ratio for ethanol is only about 9.0. Therefore, when ethanol is used as a fuel in a carburetor set for ordinary fuel, the ethanol, which only needs 9.0 volumes of air, is actually receiving 14.6 volumes. The result is that more air is in the mixture than is needed, and the mixture is said to be "lean." This results in a cold engine being much more difficult to start with ethanol than with ordinary fuels. Furthermore, as indicated previously, studies have shown that when a 100% ethanol fuel is used in a typical automobile engine, the fuel fell short in terms of power as compared with straight gasoline or blends of about 10% to 25% ethanol and gasoline. This has been directly attributed to the fact that the 100% ethanol fuel was running on a "lean" mixture. This is one of the reasons that prior art attempts to using an ethanol-based fuel have required significant modifications to the engine, particularly in the carburetion system.

Another significant problem encountered by the prior art in using ethanol as a fuel is that of phase separation. When ethanol and hydrocarbon fuels (such as gasoline) are blended together, the addition of even a small amount of water to the fuel blend will cause the gasoline, ethanol, and water components to separate. This has been one of the significant problems with gasohol where extreme care has been taken to make sure that there is no water in the fuel. The significance of the phase separation problem becomes apparent when it is appreciated that 100% ethanol is difficult to obtain since ethanol can ordinarily only be distilled in a concentration of 95% ethanol, the remaining 5% being water; expensive and time-consuming operations are necessary to remove this last 5% water.

BRIEF SUMMARY AND OBJECTS OF THE INVENTION

The present invention relates to blended ethanol-based fuels which can be used in existing engines. Through the use of additives, the blended ethanol fuel of the present invention overcomes the problems of the prior art which led researchers away from using ethanol as an engine fuel.

The stoichiometrical problem (which cause a lean mixture of the ethanol fuel) has been corrected by the addition of small amounts of a gaseous hydrocarbon fuel to the ethanol, in order to increase the volatility of the ethanol sufficient to allow for efficient starting, warmup, and running of the engine under almost any driving or operating condition. The deterioration in the power curve at high concentrations of ethanol has been improved by the addition of significant amounts of water to the ethanol. In fact, the resultant fuel provides a power curve which is superior in performance to that of most petroleum fuels. Despite the presence of water, the problem of phase separation has been eliminated by adding small amounts of a binding component to the ethanol mixture. Further, the present invention contemplates the addition of oils or other additives in order to lubricate and protect the internal components of the engine with which the ethanol-based fuel mixture comes in contact.

It will be appreciated that this ethanol-based fuel has been blended so that it can be used in the typical passenger automobile without modification to the engine or its carburetor. Furthermore, it will become apparent that other blends of this ethanol fuel may be used in high compression airplane engines, in large "diesel" engines, such as trucks and tractors, in marine engines, and even in jet engines.

It is, therefore, a primary object of the present invention to provide blended ethanol-based fuels which can be used in internal combustion engines, such as in automobiles, preferably without any modification to those engines or their carburetors.

It is also an object of the present invention to provide blended ethanol fuels which are capable of efficient operation in truck, tractor, airplane, marine, and jet engines.

It is another object of the present invention to provide blended ethanol-based fuels which eliminate the problems of difficult engine starting, slow engine warmup, power curve deterioration, and phase separation of the components of the ethanol fuel.

It is still another object of the present invention to provide ethanol-based fuels which are capable of properly lubricating and protecting the internal parts of the engine.

It is a further object of the present invention to provide an ethanol-based fuel which is practically and economically comparable to ordinary petroleum fuels.

These and other objects and features of the present invention will become more fully apparent from the following description and appended claims.

DETAILED DESCRIPTION OF THE INVENTION

The invention is directed to blends of components in ethanol-based fuels which have the advantages of excellent power curves (without the need of special injection equipment), high octane ratings, and minimal pollution, which can be produced at reasonable cost, and which result in a clean running engine with less engine overhaul and wear. Furthermore, the blended ethanol fuels of the present invention have solved the problems encountered in the prior art: (1) the stoichiometric variance between gasoline and ethanol, which causes difficulty in starting, warmup, and smooth engine operation, (2) the deterioration of the power curve as the fuel mixture approaches pure ethanol, and (3) the problem of phase separation when ethanol and other hydrocarbon components are blended in the presence of water.

The present invention has corrected the stoichiometric problem by the addition of small amounts of a gaseous hydrocarbon fuel to the ethanol. The presence of such gaseous hydrocarbons sufficiently changes the volatility of the ethanol so that an engine will start, warmup, and run effectively under almost any condition with performance comparable to that of ordinary petroleum fuels, particularly gasoline. The choice of the particular gaseous hydrocarbon fuel and the amount which is to be used will be dependent to a certain extent upon the operating conditions of the engine, such as the air temperature, the operating temperature, and the strain placed on the engine.

Although the present inventon encompasses the use of any gaseous lower alkane, alkene, alkyne, or diene, cycloform thereof, or lower aryl compounds, the preferred additives include gaseous hydrocarbons having from one to six carbon atoms. However, it has been found that acetylene and propane are particularly effective additives because of the affinity of ethanol for these compounds. Furthermore, both propane and acetylene are available or can be produced in quantities necessary for the present invention at a reasonable cost. Acetylene is particularly useful when the operating conditions include cold weather. This is because acetylene burns hotter than ethanol, and it will add specific heat to the system resulting in better engine performance. Accordingly, such additional heat will aid the starting, warmup, and continued smooth running of the engine in colder climates. In a warmer climate where such added heat is not necessary, propane, or other lower alkanes, will reduce the volatility of the ethanol sufficient to eliminate starting problems without adding excess heat to the engine. It will be appreciated that highly unsaturated lower hydrocarbons, such as butadiene and benzene, might be used as an additive where high amounts of heat must be added to the ethanol fuel. Nevertheless, since an important object of the present invention is to provide an economically competitive alternative fuel, it must be remembered that the cost of the additive is also an important factor to be considered and may be determinative of the preferred additive.

If the amount of the gaseous hydrocarbon is too small, the volatility of the blended fuel will not significantly change, and accordingly, modification in the carburetor venturi or other engine components may be necessary. On the other hand, an engine could function on rather high concentrations of the gaseous hydrocarbon in the ethanol fuel; however, for economic reasons, it is advantageous to use the least amount of the gaseous hydrocarbon additive as possible. The preferred amount of this gaseous hydrocarbon additive will, therefore, be dependent upon the particular additive used and the operating conditions of the engine.

For example, a blend for winter use will require a higher concentration of the gaseous hydrocarbon in order to make starting easier. In the summer, a lower concentration would be desirable to allow for a cooler running engine. Furthermore, if adding heat to the engine is a significant requirement, such as in a cooler climate, the concentration of propane in the ethanol fuel would necessarily need to be greater than if acetylene were used. Accordingly, it is within the scope of the present invention to add the gaseous hydrocarbon fuel in amounts of about 2% up to even amounts of about 30% by volume of the ethanol fuel. However, it is presently preferred that the gaseous hydrocarbon fuel should be in a concentration of about 4% to about 10% by volume, and more preferably near about 5%.

The addition of the gaseous hydrocarbon fuel to the ethanol can be accomplished by any well-known method. It has been found convenient to add the gaseous hydrocarbon by simply sparging the gaseous hydrocarbon (spraying finely divided bubbles of the gas under pressure) through the ethanol. Because of the affinity of ethanol for gaseous hydrocarbons, the gaseous hydrocarbon will be easily absorbed. The concentration of the hydrocarbon can be easily determined by sparging it through the final concentration of ethanol (in water) until the volume has increased by the desired amount. Somewhat surprisingly, it has been found that the gaseous hydrocarbon will remain dissolved in the ethanol under the wide range of temperature and engine operating conditions which are typically encountered. Although propane has been found to be more easily absorbed by the ethanol than acetylene, acetylene is often the preferred additive because of the need to increase specific heat.

The power curve deterioration experienced in the prior art has been improved in the present invention by the addition of water to the ethanol fuel. This addition gives the same boost to an engine that a water-injection system attached to the carburetor gives to high performance engines. However, unlike conventional water-injection systems, the present invention uses water as a part of the fuel which is stored with and used in the same feedline as the other components of the fuel without the problems associated with such storage and use in the past. It will be appreciated that water in the fuel has been a significant problem with ordinary petroleum fuels. The water in the ethanol fuel provides a boost to the engine because the water is vaporized into steam, thereby cooling the cylinder head and allowing the cylinder to operate at the peak of its power curve without the addition of any BTU's to the process.

The invention contemplates the addition of water up to an amount equal to the amount of ethanol. The fuel solution must always be at least 100 proof ethanol (that is, there must be at least as much ethanol as water by volume) in order for the fuel to ignite and burn. The presently preferred embodiment is to have the ethanol concentration between about 140 proof and about 170 proof, and more preferably between about 150 proof and about 160 proof. It will be appreciated that the amounts of water to be used may be dependent to a limited extent upon the conditions under which the fuel will be subjected. For example, in colder climates, it will be desirable to have a high concentration of ethanol.

Nevertheless, from an economic viewpoint, it will be desirable to use as much water in the fuel as possible under the operating conditions. As water is a significant component in the blended fuel, a cost savings can be realized because the composition of the fuel is not the sole contributor to actual power and mileage output. Other factors such as compression, carburetor settings, spark adjustments, engine temperature, rate of forward motion, automobile design, as well as traffic conditions, driving techniques, head or tail winds, weight of car, electrical accessories, tire traction, and road composition and grade, greatly effect the power and mileage. In fact, in conventional engines, different fuels have little effect upon power and mileage because only about 25% of the fuel is actually converted to power. The key to increasing power is to allow the engine to operate at the peak of its power cycle, and the water helps rather than hinders such operation.

With the presence of water in the fuel, the added problem of phase separation of the ethanol, water, and other hydrocarbon components of the fuel must be considered. Phase separation is caused by the antipathy of water and petroleum fuels, such as gasoline; that is, water and gasoline are immiscible. Since the fuel of the present invention is intended to be used as a substitute for ordinary petroleum fuels, it is foreseen that on some occasions mixtures of ordinary petroleum fuels and the blended ethanol fuels of the present invention may result. For example, an automobile may have part of a tank of gasoline when it is filled with a blended ethanol fuel. Furthermore, it is within the scope of the present invention to use gasoline in minor proportions as a denaturing agent in a blended ethanol fuel. However, it has been found that the addition of a small amount of a binding component will prevent phase separation.

While any well-known binding component which prevents phase separation may be used, benzene is presently preferred. Concentrations greater than about 2% by volume have been generally found to be sufficient to eliminate phase separation. The limiting factor on the upper amount of benzene in the blended fuel is its cost, when compared to the cost of the ethanol and water components of the fuel. The preferred range of the concentration of benzene is from about 4% to about 10%.

Finally, it is desirable to add a lubricating oil to the ethanol fuel in a small concentration in order to protect the internal parts of the engine, such as the cylinder walls and the fuel injectors. The principal requirements of such an oil is that it dissolves in ethanol and retains its lubricating ability under the high temperature, high pressure conditions of engine operation. Hence, while petroleum oils could be used, they are not preferable because they are often difficult to dissolve in ethanol, and if dissolved, the components of the oil tend to be broken down by the ethanol. Nevertheless, many of the modern, readily available synthetic oils are effective because they are soluble in ethanol and are able to withstand operating conditions even better than conventional petroleum oils. A typical synthetic oil is marketed under the trademark AMS/OIL. Surprisingly, oils from natural sources have also been found to work. In fact, most high grade vegetable oils will work since they continue to provide lubrication under the typical operating conditions and they readily dissolve in ethanol. Such oils include the oils prepared from the sunflower seed, castor bean, soybean, safflower, and peanut. Concentrations of the oil lubricant additive from about 1% to about 10% by volume have been found to work, with the preferred range being from about 2% to about 5% by volume of the ethanol fuel.

In addition to solving the problems encountered by the prior art, the blended ethanol fuel of the present invention has several advantages over ordinary petroleum fuels. Foremost among these is that ethanol is a cleaner burning fuel than petroleum fuels; that is, there is nearly complete combustion of the ethanol fuel without many intermediate products of combustion. This results in a savings in engine maintenance and overhaul because the internal engine parts are cleaner. The clean running of the engine is maintained because of the solvent action of ethanol which continuously dissolves any residues which may have built up.

Furthermore, the clean combustion of ethanol results in lower pollution and, in particular, less corrosive exhaust gases. One of the greatest corrosive offenders from the exhaust of petroleum fuels is sulphur dioxide, none of which is present in the exhaust of ethanol. In contrast to the combustion of the blended ethanol fuel, the combustion of petroleum fuels in the engine cylinder results in large volumes of products of incomplete combustion. This incomplete combustion causes the formation of residues, lowers the viscosity of lubricating oils, and effects the composition of the exhaust gases.

Furthermore, it has been found that automobile engines with higher compression ratios use ethanol to a better advantage than ordinary petroleum fuels. The higher the compression, the greater the advantage. Since recent designs of engines have tended toward higher compression, modern engine design and the blended ethanol fuel of the present invention are even more compatible.

Moreover, the blended fuels of the present invention have a high antiknock characteristic. Accordingly, the octane number (which is a measure of the antiknock characteristic) of the blended ethanol fuels is higher than ordinary petroleum motor fuels. This higher octance will permit a more advanced spark which will make a better use of the fuel. Hence, the distributor could even be advanced to provide ignition at an earlier point in the engine cycle although such an adjustment would not be necessary.

Additionally, the blended ethanol fuels of the present invention are less likely to cause vapor lock, which is the vaporization of a fuel in the feedlines thereby reducing the amount of fuel flow to the carburetor. Vapor lock causes loss of engine power, poor acceleration, and in extreme cases, engine stoppage. The initial boiling point of typical motor fuels is in the range of about 90° to 110° F., whereas that of ethanol is about 173° F. Hence, ethanol is much slower in vaporizing in the feedline or in the carburetor system.

A still further side benefit of the blended ethanol fuel is that statistics show that the number of fires during storage and transportation is less for ethanol than for petroleum fuels. This is because of the greater volatility and the lower flash point of the petroleum fuels.

Finally, it is noted that it may be necessary to add minor amounts of methanol to the blended ethanol fuel in order to satisfy legal requirements directed to the denaturing of all ethanol products not intended for consumption. Such amounts of methanol have not been detailed in the disclosure contained herein because they do not constitute a necessary part of the present invention.

It will be appreciated from the foregoing that many variations of the indicated components of the blended ethanol-based fuels are within the scope of the present invention. Nevertheless, in order to further illustrate possible compositions which are within the scope of the invention, the following examples are provided.

EXAMPLE 1

The following materials are blended in the indicated quantities (resulting in approximately the indicated percents):

| Material | No. of Gallons | Approximate % of Total Fuel Blend |
|---|---|---|
| Ethanol | 77 | 68% |
| Water | 23 | 20% |
| Acetylene | 5 | 4.5% |
| Benzene | 5 | 4.5% |
| Sunflower seed oil | 3 | 3% |

The above mixture results in a blend in which the ethanol concentration is about 154 proof. It has been found that the blended ethanol fuel of Example 1, when tested in an automobile engine which was "tuned" for typical gasoline consumption, eliminated the problems encountered in the prior art. There were no startup or warmup problems and no phase separation. Preliminary test data suggests that the resulting power curve is far better than that achieved by gasoline. It was further observed that the fuel resulted in less pollution.

The concentrations of acetylene and benzene used in this blend are such that this fuel will be able to operate in winter climates without having to make modifications in the engine. The acetylene concentration is sufficient to lower the volatility of the ethanol solution to allow for ease in starting and to provide heat to the engine system for efficient operation. The benzene prevents the separation of water from the other fuel components. Sunflower seed oil was used as the lubricating oil because of its ability to provide protection even at the high temperatures and pressures of engine operation and because of its ability to dissolve in ethanol.

EXAMPLE 2

| Material | No. of Gallons | Approximate % of Total Fuel Blend |
|---|---|---|
| Ethanol | 70 | 63% |
| Water | 30 | 27% |
| Propane | 5 | 4% |
| Benzene | 3 | 3% |
| Sunflower seed oil | 3 | 3% |

The blended fuel of Example 2 is designed with a lower ethanol content, the concentration being about 140 proof. This concentration allows the engine to run at a cooler temperature. Accordingly, the fuel would be ideal for hotter climates or where the engine is intended to run under stress. The use of propane, instead of acetylene, lowers the volatility of the ethanol sufficient to alleviate the starting problem without adding additional specific heat to the engine system. In a warmer climate, less benzene is needed in order to prevent the separation of water and vapor lock. As in Example 1, sunflower seed oil is used as a convenient and readily available lubricating oil.

EXAMPLE 3

| Material | No. of Gallons | Approximate % of Total Fuel Blend |
|---|---|---|
| Ethanol | 75 | 64% |
| Water | 25 | 21% |
| Acetylene | 10 | 8% |
| Benzene | 8 | 7% |

The blended fuel of Example 3 has an ethanol concentration of 150 proof, which is within the most preferred range. The high concentrations of acetylene and benzene make this fuel useful under climatic conditions of extreme cold or under conditions of severe stress, such as in race cars. Furthermore, like the blended fuel of Example 5, this fuel may be used in jet engines. While Example 3 does not disclose the addition of a lubricating oil, it will be appreciated that such may be highly desirable.

EXAMPLE 4

| Material | No. of Gallons | Approximate % of Total Fuel Blend |
|---|---|---|
| Ethanol | 80 | 67% |
| Water | 20 | 17% |
| Acetylene | 7 | 6% |
| Benzene | 8 | 7% |
| Castor oil | 4 | 3% |

This example discloses another blended fuel within the scope of the invention wherein the ethanol concentration is about 160 proof.

EXAMPLE 5

| Material | No. of Gallons | Approximate % of Total Fuel Blend |
|---|---|---|
| Ethanol | 75 | 65% |
| Water | 25 | 22% |
| Benzene | 10 | 9% |

-continued

| Material | No. of Gallons | Approximate % of Total Fuel Blend |
|---|---|---|
| Synthetic Oil | 5 | 4% |

The fuel of Example 5 is blended such that it will perform similar to modern jet fuels, such as JP-4, which are primarily kerosene. Accordingly, this fuel would be useful in jet aviation. It is particularly noteworthy that the high concentration of benzene functions not only to prevent water separation, but also to increase the octane number and the power curve. In fact, such a fuel would be expected to perform satisfactorily in "diesel" engines, such as in large trucks and tractors. Because "diesel" engines work at such high compression ratios, it is unnecessary to add a gaseous hydrocarbon component.

It is believed that within the framework of the above disclosures and examples, a blended ethanol fuel which is capable of efficiently performing in most types of engines (including automobile internal combustion engines, high compression "diesel" engines, and even jet engines) is disclosed, which fuel may be used as a substitute for petroleum-based fuels.

In view of the foregoing, it will be appreciated that the present invention may be embodied in many specific forms and in specific embodiments which are not exemplified above, without departing from the spirit or essential characteristics of the present invention. The described embodiment is to be considered in all respects only illustrative and not restrictive, and the scope of the invention is, therefore, indicated by the appended claims rather than the foregoing description. All variations which come within the meaning and range of equivalency of the claims are to be embraced within their scope.

What is claimed to be secured by United States Letters Patent is:

1. A fuel comprising:

an ethanol base having a composition by volume percent of about 70% to about 85% ethanol and about 30% to about 15% water;

a volatile hydrocarbon component in an amount of about 4% to about 10% by volume of the ethanol base, said hydrocarbon component being selected from the group consisting of lower alkanes, alkenes, alkynes, dienes, or cyclo-forms thereof, having from 1 to 6 carbon atoms; and benzene in an amount sufficient to prevent separation of the water from the other components of the fuel.

2. The fuel of claim 1 further comprising a lubricating oil component in an amount of about 1% to about 10% by volume of the ethanol base, said lubricating oil component being capable of protecting engine parts from excessive wear.

3. The fuel of claim 1 wherein the ethanol base has a composition by volume of about 75% to about 80% ethanol and about 25% to about 20% water.

4. The fuel of claim 1 wherein said volatile hydrocarbon component is acetylene.

5. The fuel of claim 1 wherein benzene is in an amount of about 3% to about 10%.

6. The fuel of claim 2 wherein said lubricating oil component is produced from sunflower seed, castor bean, safflower, or soybean.

7. The fuel of claim 6 wherein said lubricating oil component is in a concentration of about 3% to about 5%.

8. A fuel comprising:

an ethanol base having a composition by volume percent of about 70% to about 85% ethanol and about 30% to about 15% water;

acetylene in an amount of about 4% to about 10% by volume of the ethanol base;

benzene in an amount of about 3% to about 10% by volume of the ethanol base; and a lubricating oil component in an amount of about 2% to about 5% by volume of the ethanol base, said lubricating oil component being produced from sunflower seed, castor bean, safflower, or soybean.

9. The fuel of claim 1 wherein said volatile hydrocarbon component is propane.

10. The fuel of claim 1 wherein said volatile hydrocarbon component is 1-butene, 2-butene, or a mixture thereof.

11. The fuel of claim 1 wherein said volatile hydrocarbon component is butane.

* * * * *